US011441746B2

(12) United States Patent
Bai

(10) Patent No.: US 11,441,746 B2
(45) **Date of Patent: *Sep. 13, 2022**

(54) PANEL LIGHT MOUNTING STRUCTURE, A PANEL LIGHT AND MOUNTING METHOD THEREOF

(71) Applicant: NINGBO JINGHUI OPTO-ELECTRONIC CO., LTD., Zhejiang Province (CN)

(72) Inventor: Guohui Bai, Zhejiang Province (CN)

(73) Assignee: Ningbo Jinghui Opto-Electronic Co., Ltd., Zhejiang Province (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/375,402

(22) Filed: Jul. 14, 2021

(65) Prior Publication Data

US 2021/0341115 A1 Nov. 4, 2021

Related U.S. Application Data

(63) Continuation of application No. 16/744,706, filed on Jan. 16, 2020, now Pat. No. 11,079,081.

(30) Foreign Application Priority Data

Nov. 25, 2019 (CN) ..... 201911166418.9

(51) Int. Cl.
*F21S 8/04* (2006.01)
*F21V 21/04* (2006.01)

(52) U.S. Cl.
CPC ..... *F21S 8/043* (2013.01); *F21V 21/045* (2013.01); *F21V 21/047* (2013.01)

(58) Field of Classification Search
CPC ..... F21S 8/036; F21S 8/043; F21V 21/045; F21V 21/047
See application file for complete search history.

(56) References Cited

U.S. PATENT DOCUMENTS

2020/0080709 A1* 3/2020 Boulanger ..... F21V 21/03

* cited by examiner

*Primary Examiner* — Sean P Gramling
(74) *Attorney, Agent, or Firm* — Charles C. Achkar; Ostrolenk Faber LLP.

(57) ABSTRACT

The present invention discloses a panel light mounting structure, a panel light and mounting method thereof. The panel light mounting structure comprises a fixing slot disposed on the back of the light body and a mounting bracket to snap-connect with the matching fixing slot. The present invention adopts a sliding and snap-in method to match and connect the panel light body with the mounting bracket. The installation is easy and fast, and the ceiling-mount effect is excellent. In addition, the present invention may also achieve the blinds operation during the panel light installation process.

10 Claims, 6 Drawing Sheets

PANEL LIGHT MOUNTING STRUCTURE, A PANEL LIGHT AND MOUNTING METHOD THEREOF

TECHNICAL FIELD

The present invention relates to the technical field of light fixtures, and in particular, to a panel light mounting structure, a panel light, and mounting method thereof.

PRIOR ART

Existing panel lights are usually installed by ceiling mounting method, but the existing structure of ceiling mounted panel lights is usually done by providing corresponding openings on the outside of shell of the panel lights, followed by screwing through the openings and affixing the shell to the mounting bracket. This mounting structure affects the overall appearance of the light and is not easy to install.

SUMMARY OF THE INVENTION

The technical problem to be solved by the present invention is to overcome the technical defects of the prior art, and to provide a panel light mounting structure, a panel light and mounting method thereof. The present invention adopts a sliding snap-in method to match and connect the panel light body with the mounting bracket. The installation is easy and fast, and the ceiling mount effect is excellent. In addition, the present invention may also achieve the blind operations during the panel light installation process.

A panel light mounting structure, comprising a fixing slot disposed on the back of the light body, and a mounting bracket matching and snap-connected with the fixing slot. The fixing slot comprises a first fixing slot and a second fixing slot, and the two are arranged opposite each other. One side of the first fixing slot faces the mounting bracket and forms a first accommodating surface. One side of the first accommodating surface forms a first abutting surface. The top of the first accommodating surface forms a second abutting surface. One side of the second fixing slot faces the mounting bracket and forms a second accommodating surface. One side of the second accommodating surface forms a third accommodating surface. The other side of the second accommodating surface forms a third abutting surface. The top of the second accommodating surface forms a fourth abutting surface. The mounting bracket comprises a bottom plate, a first bent plate and a second bent plate formed by bending both ends of the bottom plate respectively, and a first snap-in plate and a second snap-in plate, which are formed by extending the first bent plate and the second bent plate laterally outward, respectively. The first snap-in plate passes through the first accommodating surface and slides into the first fixing slot, and simultaneously passes through the first abutting surface and the second abutting surface and snap-connects with the matching first fixing slot. The second snap-in plate passes through the second accommodating surface and the third accommodating surface and slides into the second fixing slot, and simultaneously passes through the third abutting surface and the fourth abutting surface and snap-connects with the matching second fixing slot.

Further, the width of the first fixing slot is double or equal to the width of the second fixing slot. The width of the first snap-in plate and the second snap-in plate is smaller or equal to the width of the second fixing slot respectively. The other side of the first accommodating surface forms the fifth abutting surface.

Further, the bottom of the first fixing slot extends laterally to both sides to form a first fixing plate. The bottom of the second fixing slot extends laterally to both sides to form a second fixing plate. The first fixing plate and the second fixing plate are respectively provided with fixing holes.

Further, mounting holes are respectively provided on two sides of the bottom plate.

Further, hook brackets are respectively provided on both sides of the bottom plate.

The lower surfaces of the first fixing plate and the second fixing plate are respectively recessed to form guide slots.

Further, a connecting plate is disposed between the bottom plates. A positioning plate is provided on the connecting plate.

Further, the connecting plate is matched and connected with the middle of the bottom plate. The positioning plate is matched and connected with the middle of the connecting plate. The bottom plate includes a first bottom plate and a second bottom plate arranged in parallel and spaced apart. The connecting plate includes a first connecting plate and a second connecting plate arranged in parallel and spaced apart. Both ends of the first connecting plate and the second connecting plate intersect perpendicularly with the first bottom plate and the second bottom plate respectively. Both ends of the positioning plate intersect with the first connecting plate and the second connecting plate respectively. A through hole is provided in the middle of the positioning plate, and the outside of the through hole is spaced apart and evenly distributed with positioning holes.

Further, the positioning hole includes a slotted hole and an arc hole provided between the two adjacent slotted holes.

A panel light, wherein the panel light comprises a panel light body, and a panel light mounting structure are disposed on the back of the panel light body.

Mounting method of a panel light, wherein the panel light comprises a panel light body, and a panel light mounting structure disposed on the back of the panel light body. The mounting method of the panel light includes the following steps:

A. Turn off the power.

B. Fix the mounting bracket on the surface of the fixture.

C. Connect the electric wire to the panel light body.

D. One side of the panel light body and the first fixing slot are positioned unilaterally, that is, the panel light body is pushed in a first direction, and the first snap-in plate slides into the first accommodating surface, then passes through the first abutting surface and the second abutting surface, and snap-connects with the matching first fixing slot.

E. Raise the other end of the panel light body and position the second fixing slot through the second snap-in plate.

F. Push the first snap-in plate in a direction opposite the first direction by a distance greater than or equal to the width of the second fixing slot. At this time, the fifth abutting surface blocks the first snap-in plate, so that the first snap-in plate moves always in the first fixing slot.

G. Push the panel light body toward the first direction again, and the first snap-in plate passes through the first accommodating surface, slides into the first fixing slot, and simultaneously passes through the first abutting surface and the second abutting surface and snap-connects with the matching first fixing slot. The second snap-in plate passes through the second accommodating surface and the third accommodating surface, slides into the second fixing slot, and simultaneously passes through the third abutting surface and the fourth abutting surface and snap-connects with the matching second fixing slot.

Compared with the prior art, the present invention has the following advantages:

(1) The present invention adopts a sliding and snap-in method to match and connect the panel light body with the mounting bracket. The installation is easy and fast, and the ceiling mount effect is excellent.

(2) By setting the width of the first fixing slot at double or equal to the width of the second fixing slot, and the width of the first snap-in plate and the second snap-in plate is smaller or equal to the width of the second fixing slot respectively, and by setting up a fifth abutting surface, so that the first snap-in plate moves always in the first fixing slot, the present invention achieves blind operations during panel light installation process.

(3) In the present invention, one end of the safety wire is affixed to a screw connecting the fixing hole and the panel light body, and the other end is affixed to a hook bracket, thereby improving the safety of installation process.

(4) The mounting bracket of the present invention forms a grid structure, which is suitable for the installation of large panel lights, making the connection more stable and secure.

(5) The present invention uses a positioning plate, positioning holes and other structures to position and install the mounting bracket, resulting in a simple structure and easy operation.

(6) The mounting bracket of the present invention is housed on the back of the panel light body. The mounting bracket is ultra-thin and not externally exposed, and the panel light is more aesthetic after installation.

(7) The mounting bracket of the present invention is low in cost, thus effectively solves the cost problem. Apart from saving in installation material, it is also very reliable. It is suitable for the installation of various surface-mounted panel lights, and is safe, easy, fast and neat.

Figure 1:
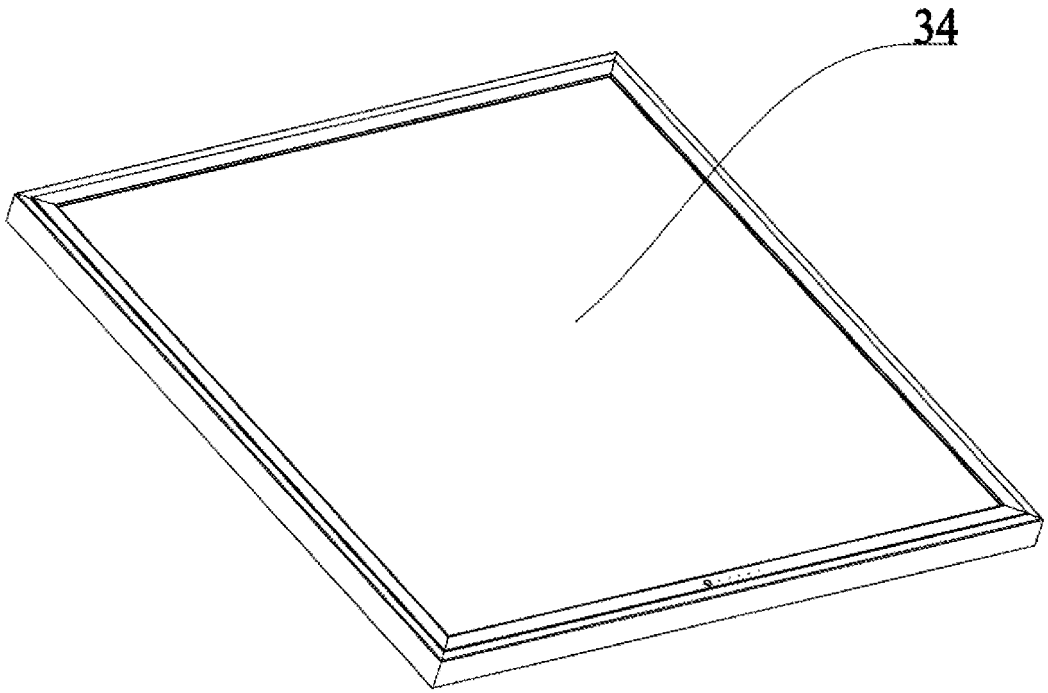
FIG. 1 is a perspective structural diagram of a panel light in Embodiments 1~3 of the present invention.
Figure 2:
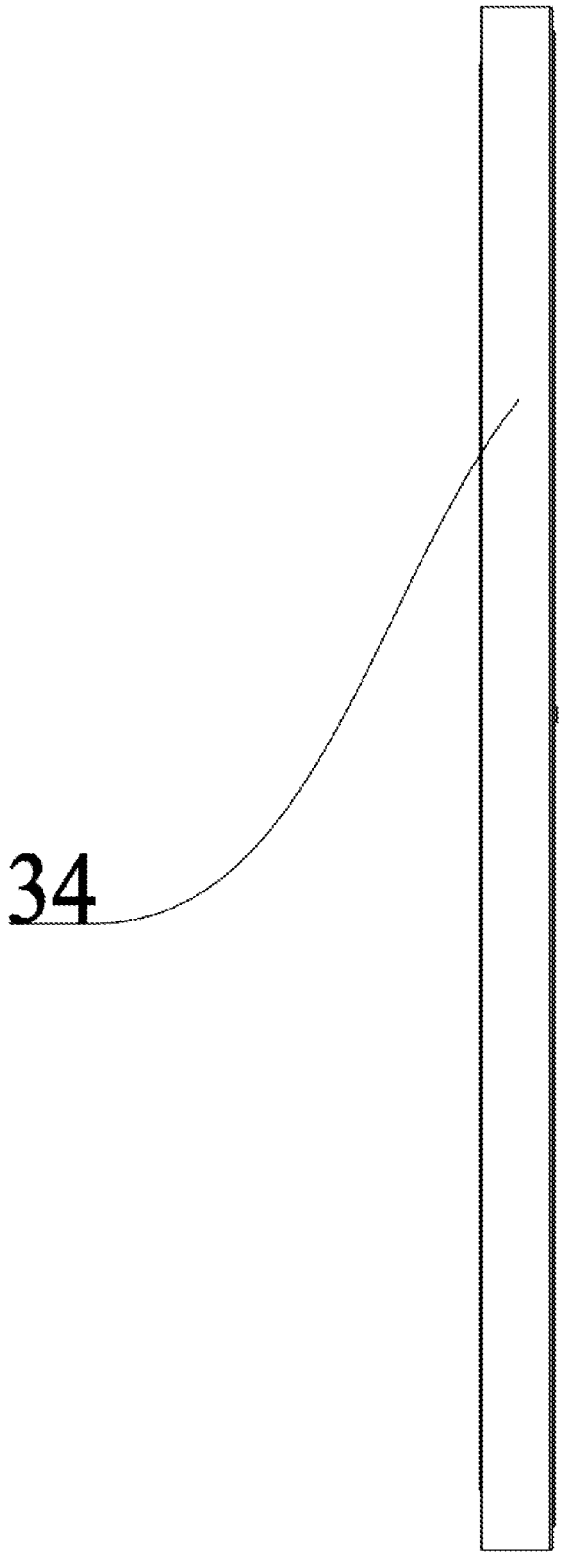
FIG. 2 is a side structural diagram of a panel light in Embodiments 1~3 of the present invention.

The corresponding component names of each reference numeral in the figures are:

1—Fixing slot
2—Mounting bracket
3—First fixing slot
4—Second fixing slot
5—First accommodating surface
6—First abutting surface
7—Second abutting surface -continued 8—Second accommodating surface
9—Third accommodating surface
10—Third abutting surface
11—Fourth abutting surface
12—Bottom plate
13—First bent plate
14—Second bent plate
15—First snap-in plate
16—Second snap-in plate
17—Fifth abutting surface
18—First fixing plate
19—Second fixing plate
20—Fixing holes
21—Mounting holes
22—Hook brackets
23—Guide slots
24—Connecting plate
25—Positioning plate
26—First bottom plate
27—Second bottom plate
28—First connecting plate
29—Second connecting plate
30—Through hole
31—Positioning holes
32—Slotted hole
33—Arc hole
34—Panel light body

DETAIL DESCRIPTION OF THE INVENTION

To better understand the content of the present invention, a more specific description is given by the following specific embodiments and accompanying figures. It should be understood that these embodiments are only used to further illustrate the present invention, and are not used to limit the scope of the present invention. In addition, it should be understood that after reading the content of the present invention, those skilled in the art may make some non-essential changes or adjustments to the present invention, which still falls within the protection scope of the present invention.

Embodiment 1

A panel light mounting structure, as shown in FIGS. 1~7, comprising a fixing slot 1 disposed on the back of the light body, and a mounting bracket 2 matching and snap-connected with the fixing slot 1. The fixing slot 1 comprises a first fixing slot 3 and a second fixing slot 4, and the two are arranged opposite each other. One side of the first fixing slot 3 faces the mounting bracket 2 and forms a first accommodating surface 5. One side of the first accommodating surface 5 forms a first abutting surface 6. The top of the first accommodating surface 6 forms a second abutting surface 7. One side of the second fixing slot 4 faces the mounting bracket 2 and forms a second accommodating surface 8. One side of the second accommodating surface 8 forms a third accommodating surface 9. The other side of the second accommodating surface 8 forms a third abutting surface 10. The top of the second accommodating surface 8 forms a fourth abutting surface 11. The mounting bracket 2 comprises a bottom plate 12, a first bent plate 13 and a second bent plate 14 formed by bending both ends of the bottom plate 12 respectively, and a first snap-in plate 15 and a second snap-in plate 16, which are formed by extending the first bent plate 13 and the second bent plate 14 laterally outward, respectively. The first snap-in plate 15 passes through the first accommodating surface 5 and slides into the first fixing slot 3, and simultaneously passes through the first abutting surface 6 and the second abutting surface 7 and snap-connects with the matching first fixing slot 3. The second snap-in plate 16 passes through the second accommodating surface 8 and the third accommodating surface 9 and slides into the second fixing slot 4, and simultaneously passes through the third abutting surface 10 and the fourth abutting surface 11 and snap-connects with the matching second fixing slot 4.

Figure 3:
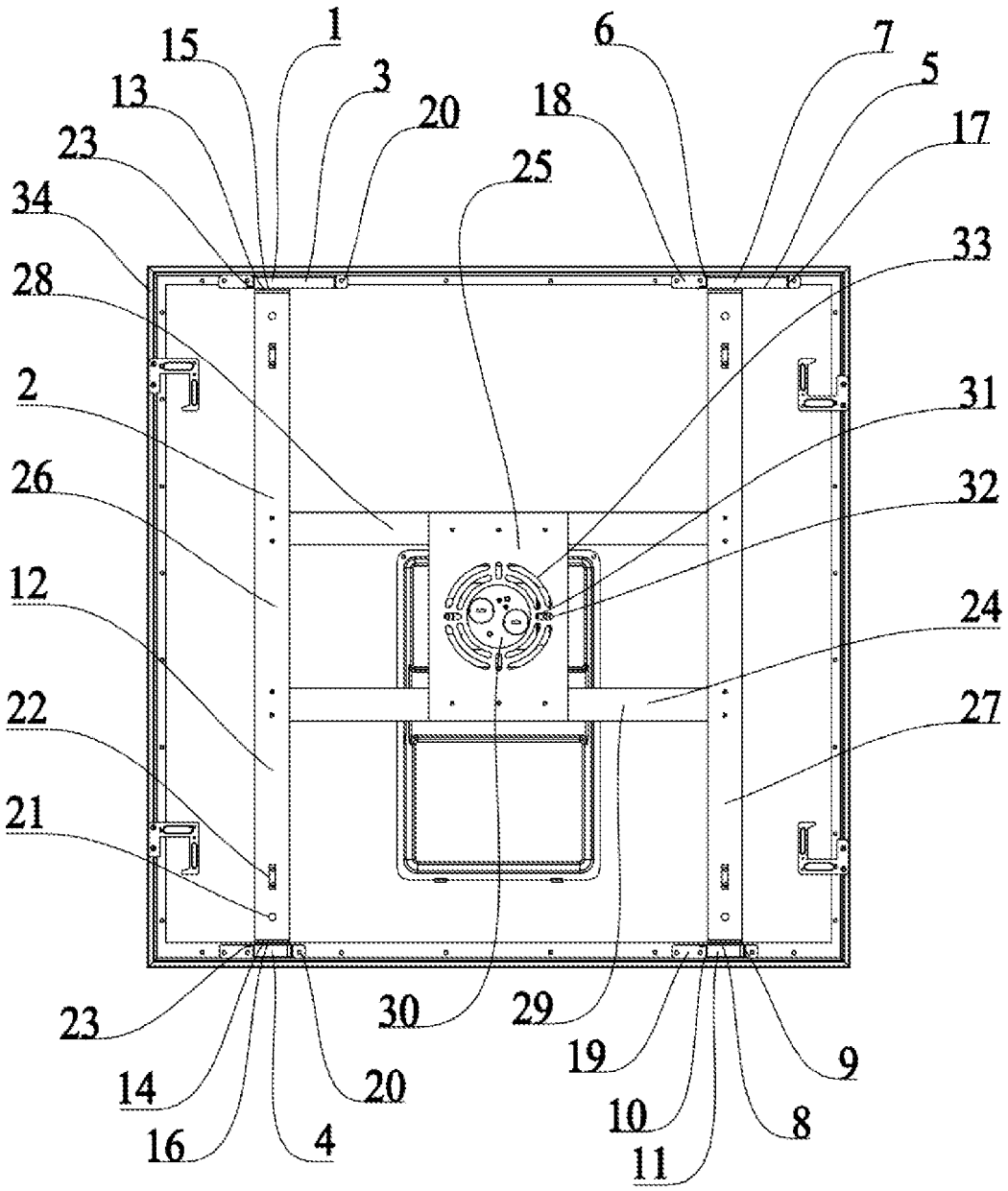
FIG. 3 is a rear structural diagram of a panel light in Embodiments 1~3 of the present invention.
Figure 4:
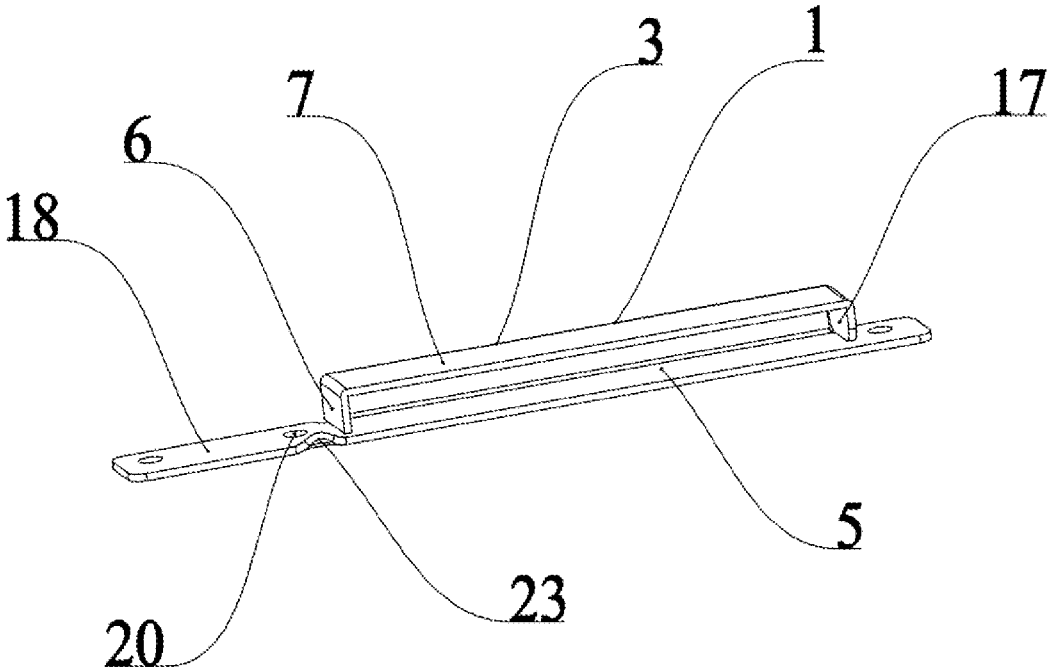
FIG. 4 is a structural diagram of a first fixing slot in Embodiments 1~3 of the present invention.
Figure 5:
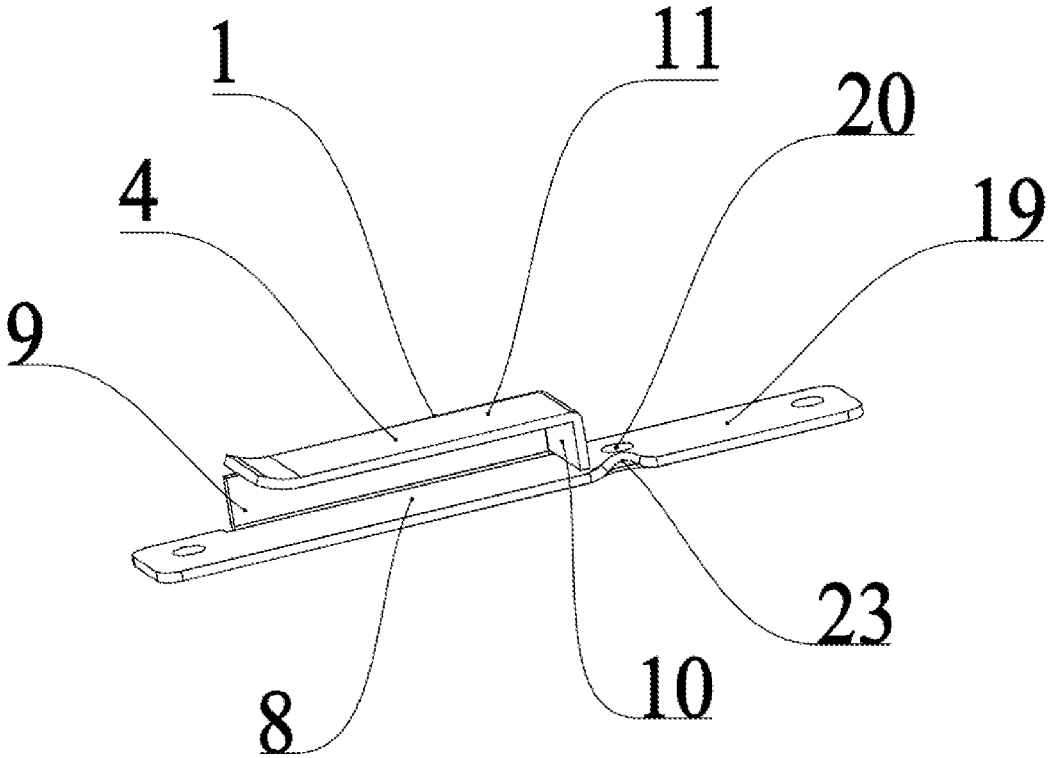
FIG. 5 is a structural diagram of a second fixing slot in Embodiments 1~3 of the present invention.
Figure 6:
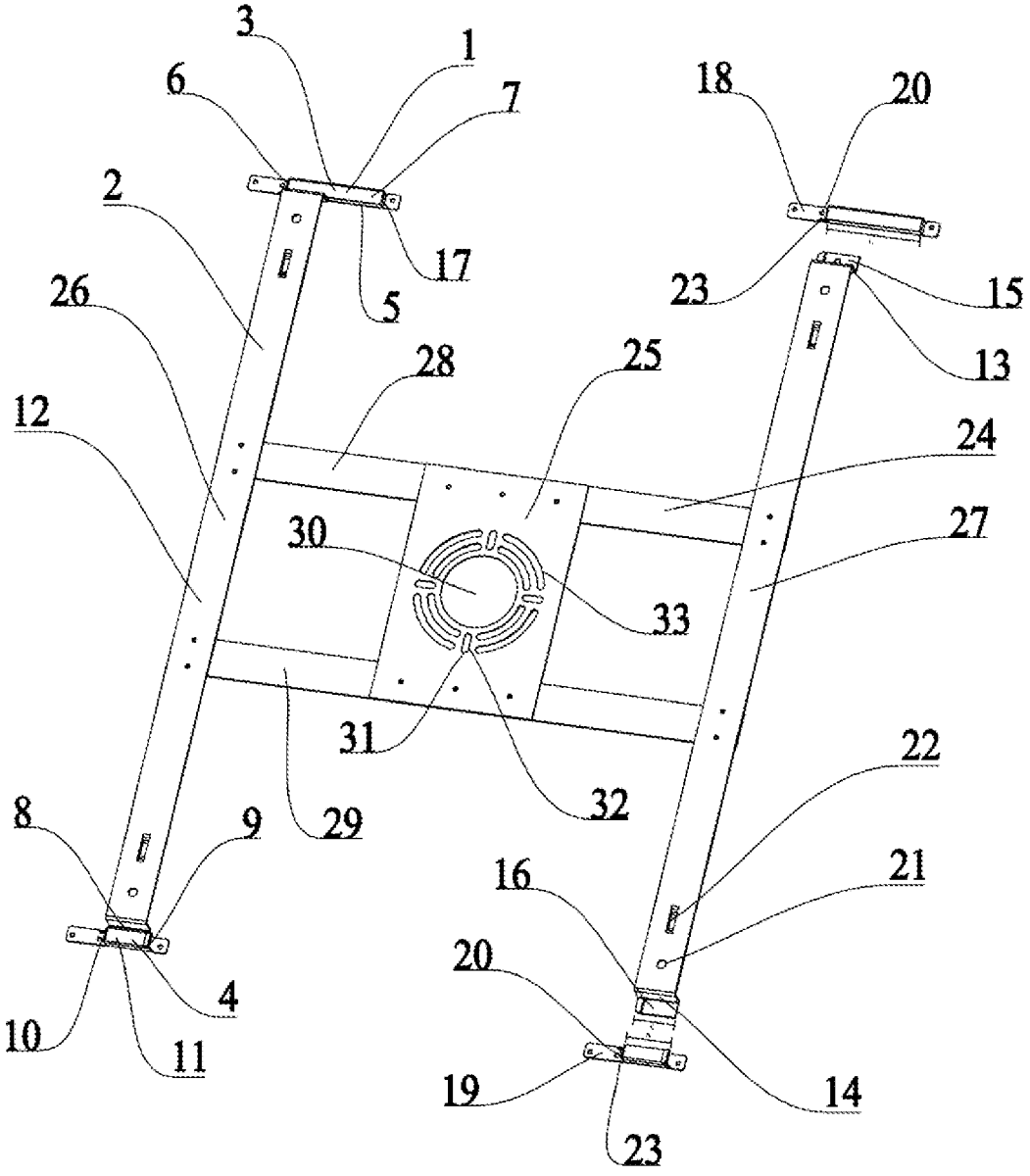
FIG. 6 is a partial exploded diagram of the matching between the mounting bracket and the fixing slot in Embodiments 1~3 of the present invention.
Figure 7:
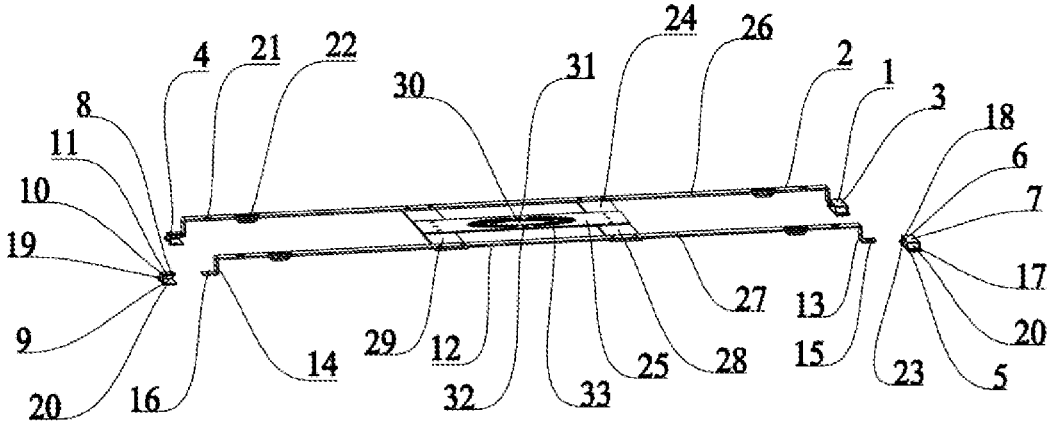
FIG. 7 is a partial exploded diagram of the matching between the mounting bracket and the fixing slot from another angle in Embodiments 1~3 of the present invention.

As shown in FIG. 3 and FIG. 6, the front opening of the first fixing slot 3 forms the first accommodating surface 5. The left side of the first fixing slot 3 forms the first abutting surface 6, and the top of the first fixing slot 3 forms the second abutting surface 7.

As shown in FIG. 3 and FIG. 6, the front opening of the second fixing slot 4 forms the second accommodating surface 8, and the right opening of the second fixing slot 4 forms the third accommodating surface 9. The second accommodating surface 8 and the third accommodating surface 9 are mutually connected. The left side of the second fixing slot 4 forms the third abutting surface 10, and the top of the second fixing slot 4 forms the fourth abutting surface 11.

By adopting the sliding and snap-in method to match and connect the panel light body 34 with the mounting bracket 2, the installation is easy and fast, and the ceiling mount effect is excellent.

The width of the first fixing slot 3 is double or equal to the width of the second fixing slot 4. The width of the first snap-in plate 15 and the second snap-in plate 16 is smaller or equal to the width of the second fixing slot 4 respectively. As shown in FIG. 6, $b \geq 2a$, and $c \leq a$. The other side of the first accommodating surface 3 forms the fifth abutting surface 17.

By the above setup, the first snap-in plate 15 moves always in the first fixing slot 4, thereby achieves the blind operations during panel light installation process.

The bottom of the first fixing slot 3 extends laterally to both sides to form the first fixing plate 18. The bottom of the second fixing slot 4 extends laterally to both sides to form the second fixing plate 19. The first fixing plate 18 and the second fixing plate 19 are respectively provided with fixing holes 20. By the above setting, it is easy to fix the first fixing slot 3 and the second fixing slot 4 to the back of the panel light body 34.

Mounting holes 21 are respectively provided on two sides of the bottom plate 12, so that it is easy to fix the mounting bracket 2 on the surface of a fixture such as a wall or a ceiling.

Hook brackets 22 are respectively provided on both sides of the bottom plate 12. The hook brackets 22 are disposed inside the mounting holes 21. The lower surfaces of the first fixing plate 18 and the second fixing plate 19 are respectively recessed to form guide slots 23.

One end of the safety thread is affixed to a screw connecting the fixing hole 20 and the panel light body 34. The safety wire passes through the guide slot 23. The other end of the safety wire is affixed to the hook bracket 22 of the mounting bracket 2, thereby improves the safety of installation process. The entire installation of the panel light can be completed by one person.

The connecting plate 24 is disposed between the bottom plates 12. The positioning plate 25 is provided on the connecting plate 24.

The connecting plate 24 is matched and connected with the middle of the bottom plate 12. The positioning plate 25 is matched and connected with the middle of the connecting plate 24. The bottom plate 12 includes a first bottom plate 26 and a second bottom plate 27 arranged in parallel and spaced apart. The connecting plate 24 includes a first connecting plate 28 and a second connecting plate 29 arranged in parallel and spaced apart. Both ends of the first connecting plate 28 and the second connecting plate 29 perpendicularly intersect the first bottom plate 26 and the second bottom plate 27 respectively. Both ends of the positioning plate 25 intersect with the first connecting plate 28 and the second connecting plate 29 respectively. A through hole 30 is provided in the middle of the positioning plate 25, and the outside of the through hole 30 is spaced apart and evenly distributed with positioning holes 31.

The mounting bracket 2 is formed into a grid structure as described above, which is suitable for the installation of large panel lights such as square panel lights, making the connection more stable and secure. At the same time, the mounting bracket 2 is positioned by disposing the positioning plate 25, the positioning holes 31 and other structures, which result in a simple structure and easy operations.

The bottom plate 12, connecting plate 24 and positioning plate 25 in the grid mounting bracket are made of steel, and are riveted to each other. The fixing slot 1 is also made of steel, and the cost of the entire panel light installation structure is low.

The positioning holes 31 include a slotted hole 32 and an arc hole 33 provided between the two adjacent slotted holes 32.

There is a total of four slotted holes.

By the setting above, the positioning plate 25 can be adapted to wiring boards of different specifications, and the positioning accuracy is improved.

Embodiment 2

A panel light comprises a panel light body 34 and a panel light mounting structure disposed on the back of the panel light body 34 according to Embodiment 1.

The mounting bracket 2 is housed on the back of the panel light body 34. The mounting bracket 2 is ultra-thin and not externally exposed, and the panel light is more aesthetic after installation.

Embodiment 3

Mounting method of a panel light. The panel light comprises a panel light body 34, and a panel light mounting structure disposed on the back of the panel light body 34 according to Embodiment 1. The mounting method of the panel light includes the following steps, as shown in FIG. 3 and FIG. 6:

A. Turn off the power.

B. Fix the mounting bracket 2 on the surface of the fixture.

C. Connect the electric wire to the panel light body 34.

D. One side of the panel light body 34 and the first fixing slot 3 are positioned unilaterally, that is, the panel light body 34 is pushed in a first direction, and the first snap-in plate 15 passes through the first abutting surface 6 and the second abutting surface 7 and slides into the first accommodating surface 5, and snap-connects with the matching first fixing slot 3.

E. Raise the other end of the panel light body 34, and position the second fixing slot 4 through the second snap-in plate 16.

F. Push the first snap-in plate 15 in a direction opposite the first direction by a distance greater than or equal to the width of the second fixing slot 4. At this time, the fifth abutting surface 17 blocks the first snap-in plate 15, so that the first snap-in plate 15 moves only in the first fixing slot 3.

G. Push the panel light body 34 toward the first direction again, and the first snap-in plate 15 passes through the first accommodating surface 5 and slides into the first fixing slot 3, and simultaneously passes through the first abutting surface 6 and the second abutting surface 7 and snap-connects with the matching first fixing slot 3. The second snap-in plate 16 passes through the second accommodating surface 8 and the third accommodating surface 9 and slides into the second fixing slot 4, and simultaneously passes through the third abutting surface 10 and the fourth abutting surface 11 and snap-connects with the matching second fixing slot 4.

The specific installation process of the panel light of the present invention is as follows, as shown in FIG. 3 and FIG. 6:

A. Turn off the power.

B. Locate the live, neutral and ground wires at the installation position.

C. Fasten screws through the positioning holes 31 in the positioning plate 25 to connect the positioning plate 25 to the junction box, thereby determining the installation position of the mounting bracket 2.

D. Mark the installation position of the mounting bracket by placing the mounting holes on the surface of the fixture such as the wall or ceiling.

E. Take off the mounting bracket 2 from the junction box.

F. Use an impact drill to drill holes on the marked surface of the fixture such as the wall or ceiling.

G. Fasten expansion screws or toggle bolts through the mounting holes 21 and drilled holes, and fix the mounting bracket 2 to the surface of the fixture such as a wall or ceiling. At the same time, pass the wires from the junction box through the through holes 30.

H. Fix one end of the safety wire to the screw connected to the fixing hole 20 and the panel light body 34. Let the safety wire to pass through the guide slot 23, and fix the other end of the safety wire to the hook bracket 22 of the mounting bracket 2.

I. Connect the wires in the junction box to the panel light body 34.

J. Position the upper end of the panel light body 34 and the first fixing slot 3 unilaterally, that is, push the panel light body 34 to the left. The first snap-in plate 15 slides into the first accommodating surface 5 and then passes through the first abutting surface 6 and the second abutting surface 7 and snap-connects with the matching first fixing slot 3.

K. Lift the lower end of the panel light body 34 and position the second fixing slot 4 through the second snap-in plate 16.

L. Push the first snap-in plate 15 to the right by a distance equal to or greater than the width of the second fixing slot 4. At this time, the fifth abutting surface 17 blocks the first snap-in plate 15, so that the first snap-in 15 moves only in the first fixing slot 3.

M. Push the panel light body 34 to the left again, and the first snap-in plate 15 passes through the first accommodating surface 5 and slides into the first fixing slot 3, and simultaneously passes through the first abutting surface 6 and the second abutting surface 7 and snap-connects with the matching first fixing slot 3. The second snap-in plate 16 passes through the second accommodating surface 8 and the third accommodating surface 9 and slides into the second fixing slot 4, and simultaneously passes through the third abutting surface 10 and the fourth abutting surface 11 and snap-connects with the matching second fixing slot 4.

The specific disassembly process of the panel light of the present invention is as follows, as shown in FIG. 3 and FIG. 6:

A. Turn off the power.

B. Push the panel light body 34 to the right and separate the first fixing slot 3 and the second fixing slot 4 from the first snap-in plate 15 and the second snap-in plate 16 respectively.

C. Separate the wires from the panel light body 34 and the wires from the junction box.

D. Separate the safety wire from the hook bracket.

The above description is not a limitation to the present invention, and the present invention is not limited to the above examples. Changes, modifications, additions or replacements made by those skilled in the art within the substantial scope of the invention shall also fall within the protection scope of the present invention.

What is claimed is:

1. A panel light mounting structure, comprising: a first fixing slot configured to be disposed on the back of a light body, and a mounting bracket matching and snap-connected with the first fixing slot;

wherein one side of the first fixing slot faces the mounting bracket and a bottom surface of the one side of the first fixing slot forms a first accommodating surface;

wherein a side surface of the one side of the first fixing slot forms a first abutting surface and a top surface of the one side of the first fixing slot forms a second abutting surface; and one side of a second fixing slot faces the mounting bracket and a bottom surface of the one side of the second fixing slot forms a second accommodating surface;

wherein a first side surface of the one side of the second fixing slot forms a third accommodating surface and a second side surface of the one side of the second fixing slot forms a third abutting surface and a top surface of the one side of the second fixing slot forms a fourth abutting surface; and the mounting bracket comprises a bottom plate, a first bent plate and a second bent plate formed by bending both ends of the bottom plate at a bending angle of approximately 90 degrees, respectively; and a first snap-in plate and a second snap-in plate, which are formed by the first bent plate and the second bent plate extending outward along the extending direction of the bottom plate, respectively; and the first snap-in plate slides into the first fixing slot through the first accommodating surface, and simultaneously snap-connects with the matching first fixing slot through the first abutting surface and the second abutting surface;

wherein the second snap-in plate slides into a second fixing slot through the second accommodating surface and the third accommodating surface, and simultaneously snap-connects with the matching second fixing slot through the third abutting surface and the fourth abutting surface.

2. The panel light mounting structure according to claim 1, wherein the width of the first fixing slot is double or equal to the width of the second fixing slot and the width of the first snap-in plate and the second snap-in plate are smaller or equal to the width of the second fixing slot respectively where the other side of the first accommodating surface forms a fifth abutting surface.

3. A panel light, wherein the panel light comprises a panel light body and a panel light mounting structure according to claim 1 disposed on the back of the panel light body.

4. A mounting method of a panel light, wherein the panel light comprises a panel light body and a panel light mounting structure according to claim 2 disposed on the back of the panel light body, and the mounting method of the panel light includes the following steps:

A. turn off the power;

B. affix the mounting bracket on the surface of a fixture;

C. connect an electric wire to the panel light body;

D. one side of the panel light body -and the first fixing slot- are positioned unilaterally, that is, the panel light body is pushed in a first direction, and the first snap-in plate passes through the first abutting surface and the second abutting surface and slides into the first accommodating surface, and snap-connects with the matching first fixing slot;

E. raise the other end of the panel light body, and position the second fixing slot through the second snap-in plate;

F. push the first snap-in plate in a direction opposite the first direction by a distance greater than or equal to the width of the second fixing slot where at this time, the fifth abutting surface blocks the first snap-in plate, so that the first snap-in plate moves only in the first fixing slot; and G. push the panel light body toward the first direction again, and the first snap-in plate passes through the first accommodating surface and slides into the first fixing slot, and simultaneously passes through the first abutting surface and the second abutting surface and snap-connects with the matching first fixing slot where the second snap-in plate passes through the second accommodating surface and the third accommodating surface and slides into the second fixing slot, and simultaneously passes through the third abutting surface and the fourth abutting surface and snap-connects with the matching second fixing slot.

5. A panel light mounting structure, comprising:

a first fixing slot configured to be disposed on the back of a light body, and a mounting bracket matching and snap-connected with the first fixing slot;

wherein one side of the first fixing slot faces the mounting bracket and a bottom surface of the one side of the first fixing slot forms a first accommodating surface;

wherein a side surface of the one side of the first fixing slot forms a first abutting surface and a top surface of the one side of the first fixing slot forms a second abutting surface; and one side of a second fixing slot faces the mounting bracket and a bottom surface of the one side of the second fixing slot forms a second accommodating surface;

wherein a first side surface of the one side of the second fixing slot forms a third accommodating surface and a second side surface of the one side of the second fixing slot forms a third abutting surface and a top surface of the one side of the second fixing slot forms a fourth abutting surface; and the mounting bracket comprises a bottom plate, a first bent plate and a second bent plate formed by bending both ends of the bottom plate at a bending angle of approximately 90 degrees, respectively; and a first snap-in plate and a second snap-in plate, which are formed by the first bent plate and the second bent plate extending outward along the extending direction of the bottom plate, respectively; and the first snap-in plate slides into the first fixing slot through the first accommodating surface, and simultaneously snap-connects with the matching first fixing slot through the first abutting surface and the second abutting surface;

wherein the second snap-in plate slides into a second fixing slot through the second accommodating surface and the third accommodating surface, and simultaneously snap-connects with the matching second fixing slot through the third abutting surface and the fourth abutting surface, wherein the bottom of the first fixing slot extends laterally to both sides to form a first fixing plate; wherein the bottom of the second fixing slot extends laterally to both sides to form a second fixing plate; wherein the first fixing plate and the second fixing plate are respectively provided with fixing holes.

6. The panel light mounting structure according to claim 5, wherein mounting holes are respectively provided on two sides of the bottom plate.

7. The panel light mounting structure according to claim 6, wherein hook brackets are respectively provided on both sides of the bottom plate and the lower surfaces of the first fixing plate and the second fixing plate are respectively recessed to form guide slots.

8. A panel light mounting structure, comprising:

a first fixing slot configured to be disposed on the back of a light body, and a mounting bracket matching and snap-connected with the first fixing slot;

wherein one side of the first fixing slot faces the mounting bracket and a bottom surface of the one side of the first fixing slot forms a first accommodating surface;

wherein a side surface of the one side of the first fixing slot forms a first abutting surface and a top surface of the one side of the first fixing slot forms a second abutting surface; and one side of a second fixing slot faces the mounting bracket and a bottom surface of the one side of the second fixing slot forms a second accommodating surface;

wherein a first side surface of the one side of the second fixing slot forms a third accommodating surface and a second side surface of the one side of the second fixing slot forms a third abutting surface and a top surface of the one side of the second fixing slot forms a fourth abutting surface; and the mounting bracket comprises two bottom plates, a first bent plate and a second bent plate formed by bending both ends of the bottom plate at a bending angle of approximately 90 degrees, respectively; and a first snap-in plate and a second snap-in plate, which are formed by the first bent plate and the second bent plate extending outward along the extending direction of the bottom plate, respectively; and the first snap-in plate slides into the first fixing slot through the first accommodating surface, and simultaneously snap-connects with the matching first fixing slot through the first abutting surface and the second abutting surface;

wherein the second snap-in plate slides into a second fixing slot through the second accommodating surface and the third accommodating surface, and simultaneously snap- connects with the matching second fixing slot through the third abutting surface and the fourth abutting surface;

wherein a connecting plate is disposed between the two bottom plates and a positioning plate is provided on the connecting plate.

9. The panel light mounting structure according to claim 8, wherein the connecting plate is matched and connected with the middle of each bottom plate; the positioning plate is matched and connected with the middle of the connecting plate; the two bottom plates include a first bottom plate and a second bottom plate arranged in parallel and spaced apart; the connecting plate includes a first connecting plate and a second connecting plate arranged in parallel and spaced apart; both ends of the first connecting plate and the second connecting plate intersect perpendicularly with the first bottom plate and the second bottom plate respectively; wherein both ends of the positioning plate intersect with the first connecting plate and the second connecting plate respectively; a through hole is provided in the middle of the positioning plate; and the outside of the through hole is spaced apart and evenly distributed with positioning holes.

10. The panel light mounting structure according to claim 9, wherein the positioning holes include a slotted hole and an arc hole provided between the two adjacent slotted holes.

* * * * *